United States Patent [19]

Raasch

[11] Patent Number: 4,956,969

[45] Date of Patent: Sep. 18, 1990

[54] METHOD AND APPARATUS FOR CONTROLLING THE SUPPLY OF SLIVER TO THE SPINNING STATIONS OF A SPINNING MACHINE

[75] Inventor: Hans Raasch, Moenchengladbach, Fed. Rep. of Germany

[73] Assignee: W. Schlafhorst & Co., Fed. Rep. of Germany

[21] Appl. No.: 404,340

[22] Filed: Sep. 7, 1989

[30] Foreign Application Priority Data

Sep. 17, 1988 [DE] Fed. Rep. of Germany ..... 3831639

[51] Int. Cl.[5] ..... D01H 4/00; D01H 9/00; D01H 9/18

[52] U.S. Cl. ..... 57/281; 57/90; 57/264; 57/276

[58] Field of Search ..... 57/90, 281, 276, 277, 57/264; 19/159 A, 159 R

[56] References Cited

U.S. PATENT DOCUMENTS

| | | | |
|---|---|---|---|
| 3,884,026 | 5/1975 | Yoshizawa et al. | 57/281 |
| 4,033,104 | 7/1977 | Kamp | 19/159 A X |
| 4,078,369 | 3/1978 | Brandis | 57/281 X |
| 4,150,534 | 4/1979 | Raasch | 57/276 X |
| 4,537,018 | 8/1985 | Tooka | 57/90 |
| 4,735,040 | 4/1988 | Pircher | 57/281 X |

FOREIGN PATENT DOCUMENTS

| | | |
|---|---|---|
| 2521851 | 11/1976 | Fed. Rep. of Germany . |
| 2554915 | 6/1977 | Fed. Rep. of Germany . |
| 3032474 | 4/1982 | Fed. Rep. of Germany . |
| 3505496 | 8/1986 | Fed. Rep. of Germany . |
| 3614654 | 11/1987 | Fed. Rep. of Germany . |
| 3733788 | 4/1988 | Fed. Rep. of Germany . |
| 3808465 | 9/1988 | Fed. Rep. of Germany . |
| 623614 | 6/1981 | Switzerland . |

*Primary Examiner*—John Petrakes

*Attorney, Agent, or Firm*—Shefte, Pinckney & Sawyer

[57] ABSTRACT

A method and apparatus for supplying sliver to the spinning stations of a spinning machine to wind a batch of a predetermined number of packages includes a sliver can transfer device, a sliver can conveying device, a sliver can filling device and a computer for controlling the operation of the various sliver can handling devices. Each spinning station is initially provided with a sliver can having a differing amount of sliver therein than the other sliver cans as the winding of the packages of the batch is commenced. The spinning stations are then continuously individually provided with fresh cans of sliver having a uniform amount of sliver therein during the normal running of the batch. The computer executes a batch ending program to determine an individual finishing quota of packages to be wound at each spinning station and controls the sliver can conveying device, the sliver can transfer device and the sliver can filling device to deliver a final can of sliver to each spinning station for the spinning station to complete its individual finishing quota of packages. The final can of sliver provided to each spinning station contains a predetermined quantity of sliver which is selected such that the final can is substantially empty upon the winding of the last full package of the individual finishing quota of packages at the respective spinning station.

8 Claims, 1 Drawing Sheet

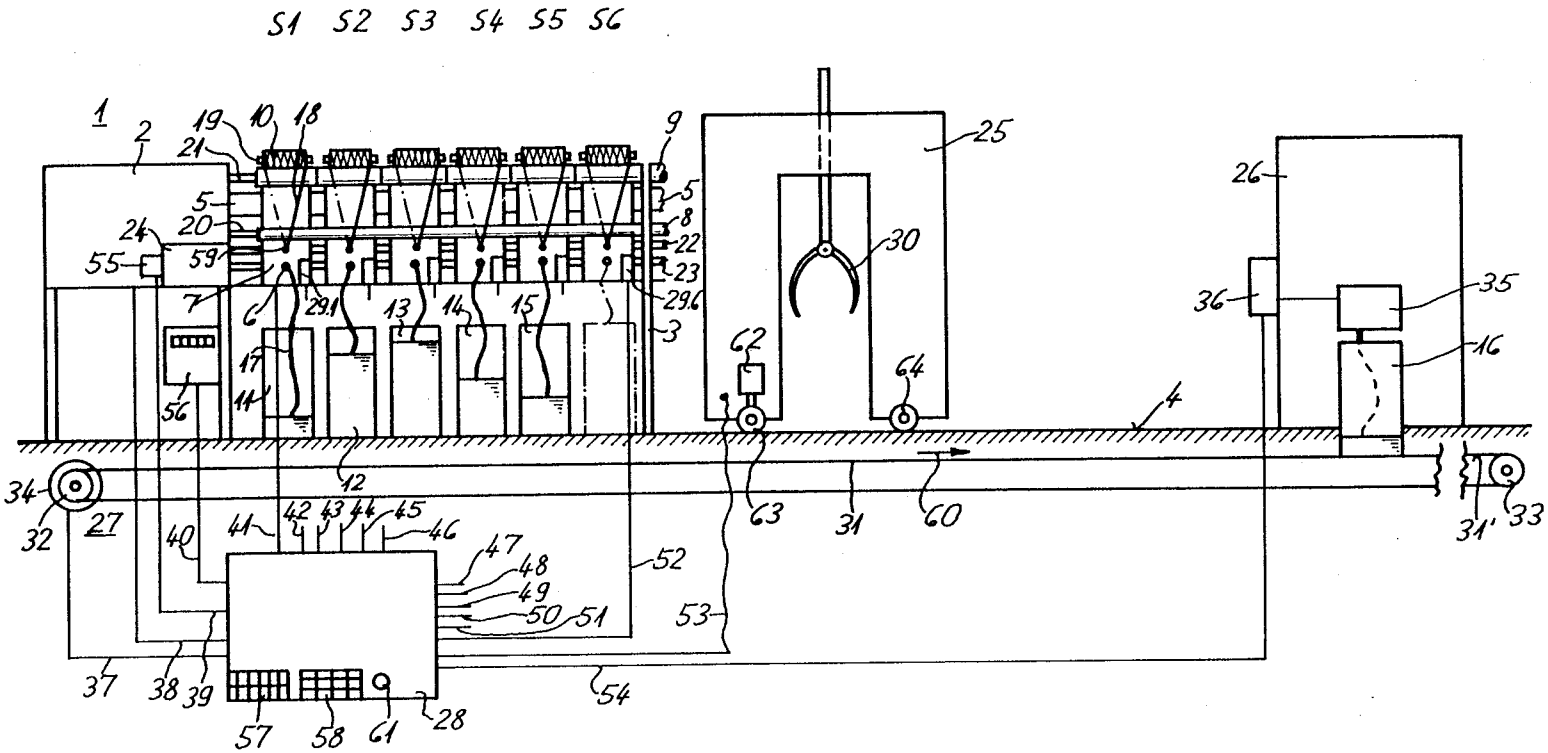
S1 S2 S3 S4 S5 S6

METHOD AND APPARATUS FOR CONTROLLING THE SUPPLY OF SLIVER TO THE SPINNING STATIONS OF A SPINNING MACHINE

BACKGROUND OF THE INVENTION

The present invention relates to a method and apparatus for controlling the supply of sliver to the spinning stations of a spinning machine.

In an automatic open end spinning machine, cans of sliver are delivered to the spinning stations of the machine for drawing in of the sliver for separation into individual fibers for spinning into yarn and winding of the yarn into packages. One common approach for replacing empty sliver cans at the spinning station includes transporting full cans of sliver to positions adjacent the spinning stations and then manually exchanging the empty sliver cans for the full sliver cans. Additionally, proposals for more fully automating the supply of sliver to the spinning stations of a spinning machine are known.

However, in the known approaches of manually exchanging empty cans for full sliver cans and for automating the sliver supply process suffer from the common disadvantage that a spinning station may be without a supply of sliver for a relatively significant amount of time while awaiting the delivery of a new sliver can and the exchange of the new can for the empty can due to a can supply and exchange taking place at another station or stations. Accordingly, the need exists for increasing the efficiency of the sliver supply process of an automatic spinning machine.

SUMMARY OF THE INVENTION

Briefly described, the present invention provides a method for controlling the operation of a spinning machine of the type having a plurality of stations for spinning sliver into yarn and winding yarn into packages, the sliver being drawn from cans at the stations, a sliver can filling device and a sliver can transport device for transporting empty cans to the sliver can filling device and cans with sliver therein from the sliver can filling device to the stations, the sliver can transport device and the sliver can filling device being cooperatively operated to provide sliver cans containing sliver to the stations individually during the contemporaneous operation of the stations in winding a batch of a predetermined number of packages. The method includes supplying each spinning stations with a first can of sliver; continuously replenishing the supply of sliver at each of the stations independently by removing cans from each station as they become empty and transporting full cans to the station; prior to completion of winding of the batch, determining an individual finishing quota of packages to be wound at each station to complete the batch, the individual finishing quota corresponding to the number of packages which can be substantially completely wound by the respective spinning station within a predetermined remaining batch running time for each station; monitoring the winding at each spinning station during the winding of the individual finishing quota of packages to determine, for each station, the number of packages to be wound from the sliver in a final can to be transported to each station; and in response to the monitoring, loading a quantity of sliver into each final can substantially equal to the quantity of sliver required to complete the winding of the individual finishing quota of packages at the respective spinning station, whereby the final sliver can of each spinning station is substantially empty upon completion of winding of the last full package of the individual finishing quota for the spinning station.

The method preferably includes setting one of a maximum sliver length to be spun to complete the batch and a spinning time to be run to complete the batch, and the determining is performed in correspondence with the completion of the next package at the respective spinning station following the setting. The supplying includes supplying cans at the start of winding of the batch with unequal length of sliver in the cans at the different stations. The monitoring of the winding of each station includes monitoring the amount of sliver drawn into the spinning station.

In the preferred embodiment, the method further includes providing a can of sliver to each spinning station for the winding of packages of another batch following the completion thereat of the last full package of the individual finishing quota of the respective spinning station independent of completion of winding of the first batch at the other stations.

According to one aspect of the invention, in the providing of a can of sliver to each spinning station for the winding of packages of another batch, the can is fully filled with sliver.

According to another aspect of the invention, the providing of a can of sliver to each spinning station for the winding of packages of another batch occurs following the winding of the last full package of the individual finishing quota of the last spinning station to complete its individual finishing quota of packages.

The present invention also provides an apparatus for controlling the operation of a spinning machine of the type having a plurality of stations for spinning sliver into yarn and winding yarn into packages, the sliver being drawn from cans at the stations. The apparatus includes a sliver can filling device for individually filling the sliver cans with a selected quantity of sliver; a sliver can transport device for transporting empty cans to the sliver can filling device and cans with sliver therein from the sliver can filling device to the stations, the sliver can transport device and the sliver can filling device being cooperatively operated to provide sliver cans containing sliver to the stations individually during the contemporaneous operation of the stations in winding a batch of a predetermined number of packages; means for determining an individual finishing quota of packages to be wound at each station to complete the batch, the individual finishing quota corresponding to the number of packages which can be substantially completely wound by the respective spinning station within a predetermined remaining batch running time for the station; and means for monitoring the winding at each spinning station during the winding of the individual finishing quota of packages to determine, for each station, the number of packages to be wound from the sliver in a final can to be transported to each station, the monitoring means and the sliver can filling device being operably connected to one another and the sliver can filling device being operable to load a quantity of sliver into each final can in response to the monitoring of the winding at each station, said quantity of sliver in each final can being substantially equal to the quantity of sliver required to complete the winding of the individual finishing quota of packages at the respective spinning station, whereby the final sliver can of each spinning station is substantially empty upon completion of the winding of the last full package of the individual finishing quota of the spinning station.

BRIEF DESCRIPTION OF THE DRAWINGS

The single figure is a front elevational schematic view of the preferred embodiment of the sliver supply apparatus of the present invention.

DETAILED DESCRIPTION OF THE PREFERRED EMBODIMENT

In the accompanying figure, an automatic open end spinning machine, generally designated as 1, includes a machine frame 2 and an intermediate frame 3. Both the frames 2, 3 stand upright on the floor 4 of an operating area in which the spinning machine 1 is disposed and the frames support therebetween a plurality of spinning stations designated S1, S2, S3, S4, S5 and S6. A support member 5 extending between the machine frame 2 and the intermediate frame 3 supports the components of each spinning station S1–S6.

Each of the spinning stations S1–S6 is operable to draw a sliver 17 out of a can of sliver positioned at the spinning station. The sliver cans are designated 11–16 and each can is associated with a respective one of the spinning stations S1–S6. Each spinning station includes a conventional spin box 7 having a sliver intake opening 6 and a yarn withdrawal opening 59. At each spinning station S1–S6, the sliver 17 is drawn into the sliver intake opening 6, shown with respect to the spinning station S1, to be processed by the spin box 7 into a spun yarn 18. The spun yarn 18 is continuously drawn from the spin box 7 and travels over a take-off roller 8 rotatably supported by the intermediate frame 3 and operatively connected to a shaft 20 of a central drive device in the machine frame 2 for driving rotation of the take-off roller 8. The spun yarn 18 drawn from the spin box 7 is fed by a traversing package winding device 9 onto a tube 10 rotatably supported in a creel 19 to build a package on the tube 10. The package winding device 9 is operatively connected to a shaft 21 of the central drive device in the machine frame 2 for driving rotation of the package winding device 9.

The spin boxes 7 of the spinning stations S1–S6 are commonly driven by a shaft 23 rotatably supported by the intermediate frame 3 and extending through the spinning stations to be supported at its other end by a drive motor 24 mounted to the machine frame 2.

The foregoing construction and operation are conventional and do not form a part of the present invention, except to provide the environment in which the preferred embodiment of the present invention is utilized.

In accordance with the present invention, the spinning machine 1 further includes a sliver can transport device including a movable sliver can transfer device 25 and a sliver can conveyor assembly 27, and a sliver can filling device 26. Additionally, the spinning machine 1 includes a computer 28.

The sliver can transport device is adapted to remove empty sliver cans from the spinning stations S1–S6 and to independently supply cans of sliver to the stations. To this end, the movable sliver can transfer device 25 includes a can gripping assembly 30 of conventional design for selectively grasping a sliver can at one position, moving the can to another position and releasing the can. Additionally, the movable sliver transfer device 25 includes a pair of rollers 63, 64 for supporting the device for rolling movement along the floor 4 and a roller drive motor 62 operatively connected to the roller 63. The movable sliver transfer device 25 is connected by a flexible connector 53 to the computer 28.

The sliver can conveyor assembly 27 includes an endless belt 31 trained around a pair of spaced pulleys 32, 33 and extending between the machine frame 2 and the sliver can filling device 26. The pulley 32 is drivingly connected to a conveyor belt motor 34 which is connected by a connector 37 to the computer 28. The conveyor belt motor 34 selectively reversibly rotates the pulley 32 to drive the endless belt 31 reversibly in the direction shown by the arrow 60 and in the direction opposite to the arrow 60.

The sliver can filling device 26 includes a conventional sliver loader 35 for loading sliver in conventional manner into a sliver can. The sliver loading element 35 is driven by a controllable drive device 36 which is connected via a connector 54 to the computer 28.

The drive motor 24 which drives the shaft 23 is provided with a sensor 55 which counts the rotations of the shaft 23. The sensor 55 is operatively connected via a connector 39 to the computer 28. Information which is transmitted to the computer 28 from the sensor 55 enables the computer to determine the rate at which the spin boxes 7 intake sliver.

A sliver counting device 56 is mounted to the machine frame 2 and is operatively connected by a connector 40 to the computer 28.

Each of the spinning stations S1–S6 is provided with a sliver length monitoring device 29.1–29.6, respectively which are each operatively connected by a connector 47–52, respectively, to the computer 28.

The computer 28 includes a first component 57 of conventional design for storing information such as, for example, information concerning the correlation of the sliver length, the degree of fullness of the sliver cans, the length of time to draw the sliver from a sliver can and the length of time to draw the sliver from full cans with respect to every possible yarn count and every possible sliver supply.

The computer 28 further includes a second component 58 for providing interactive capabilities to the computer, such that information with respect to a particular batch of packages to be wound can be inputted into the computer. For example, a first and second start program relating to the initiation of the winding of the packages of a batch of a predetermined number of packages at the spinning stations of the automatic spinning machine, a program for controlling the operation of the spinning stations during the normal running of the spinning operation following the completion of the respective start program, and a program for controlling the completion of the packages of the batch can all be inputted into the computer via the second component 58.

The operation of the automatic spinning machine 1 in accordance with the present invention to wind a batch of a predetermined number of packages is as follows. Each spinning station S1–S6 is provided with a tube 10, which is inserted onto the spindle 19 of the respective spinning station, which includes an initial yarn length already wound thereon and the free end of each initial yarn length is introduced into the yarn withdrawal opening 59 of the spinning box 7 of the respective spinning station. The placement of the initial bobbin 10 and the introduction of its initial yarn length into the spinning box 7 of the respective spinning station can be accomplished, for example, by a conventional device adapted for that purpose. Additionally, each spinning stations S1–S6 is initially provided with its respective sliver can 11–16.

Data is inputted to the computer 28 to enable the computer to control the running of the batch. Specifically, data concerning the characteristics of the full packages to be wound at each of the spinning stations S1–S6, such as, for example, the length of sliver required to wind a full package, the rate of withdrawal of sliver from a sliver can by each spinning station and the amount of time to withdraw the sliver needed to wind each full package are inputted into the first computer component 57. Also, the selected program for controlling the starting period of the winding of the packages, the selected program for controlling the normal winding of packages and, if desired, the selected program for controlling the completion of the batch are inputted into the second computer component 58. The running of the batch is then commenced by pressing the start button 61 of the computer 28.

In accordance with the present invention, each sliver can 11 ∝ 16 contains a differing amount of sliver. The present invention contemplates that a batch start program can by executed by the computer 28 to deliver the sliver cans 11–16 with differing amounts of sliver to the spinning stations. The batch starting program can control the sliver can delivery by at least one of two procedures for delivering cans of sliver to the spinning stations S1–S6 such that each can of sliver contains a differing amount of sliver than the other cans of sliver. In accordance with one procedure, the computer 28 controls the sliver can transfer device 25, via the connector 53, to successively transfer the sliver cans 11–16 from their initial, empty positions at their respective spinning stations to the sliver can transport assembly 27. That is, the sliver can transfer device 25 initially parks adjacent the spinning station S1, engages the sliver can 11 with its sliver can gripping element 30 and transfers the sliver can to an upright supported position on the conveyor belt 31 of the sliver can transport device 27. Then, the sliver can transfer device 25 moves to a position adjacent the spinning station S2, grips the sliver can 12 with its sliver can gripping element 30 and transfers the can to an upright supported position on the conveyor belt 31.

Once all of the sliver cans 11–16 have been transferred by the sliver can transfer device 25 to the conveyor belt 31, the computer 38 actuates the conveyor belt motor 34, via the connector 37, to rotate the belt roller 32 and thereby move the conveyor belt 31 in the direction indicated by the arrow 60 until all of the cans have been moved to the side of the sliver filling device 26 which is remote from the spinning stations S1–S6. Then, the computer 28 controls the operation of the conveyor belt motor 34 to effect rotation of the belt roller 32 in the opposite direction to thereby move the conveyor belt 31 in the direction opposite to the direction indicated by the arrow 60 until the sliver can 11 is positioned in sliver receiving position with respect to the sliver loader 35. In this regard, appropriate conventional sensors, operatively connected to the computer 28, can be mounted on the sliver filling device 26 and/or the sliver cans 11–16 to provide sensed information concerning the relative positions of the sliver loader 35 and the sliver cans 11–16. Alternatively, the conveyor belt motor 34 can be provided with a conventional control device to effect sequential positioning of the sliver cans 11–16 in sliver receiving position with respect to the sliver loader 35.

As each sliver can 11–16 is successively positioned in sliver receiving position with respect to the sliver loader 35, the sliver filling control device 36 is actuated by the computer 28 to control the operation of the sliver filler 35 to deposit a differing amount of sliver in each of the sliver cans 11–16. As each of the sliver cans 11–16 is filled with its predetermined initial sliver amount, the conveyor belt motor 34 is controlled by the computer 28 to effect limited movement of the conveyor belt 31 to move the just-filled sliver can out of sliver receiving position and to position the next sliver can to be filled in the sliver receiving position. In this manner, the sliver cans 11–16 can be filled with differing predetermined initial amounts of sliver. For example, the sliver can 11 can be filled to 20% of capacity with sliver; the sliver can 12 to 75% of capacity; the sliver can 13 to 85% of capacity; the sliver can 14 to 50% of capacity; the sliver can 15 to 30% of capacity; and the sliver can 16 to 100% of capacity.

Once the last sliver can to be filled by the sliver loader 35 has received its initial amount of sliver (e.g., once the sliver can 16 has received its predetermined initial amount of sliver), the computer 28 controls the operation of the conveyor belt motor 34 to effect movement of the conveyor belt 31 in the direction opposite to the direction indicated by the arrow 60 to position the sliver cans 11–16 adjacent their respective associated spinning stations S1–S6. Thereafter, the sliver can transfer device 25 is controlled by the computer 28 to successively transfer each of the sliver cans 11–16 from the conveyor belt 31 to the sliver withdrawal position with respect to their associated spinning stations S1–S6 and to insert the end of the sliver into the sliver intake opening 6 of the spin box 7 of the respective spinning station. In this regard, the operation of the sliver can transfer device 25 is effected in conventional manner. For example, the individual spinning stations S1–S6 can each be provided with an engagement bar which is contacted by the sliver can transfer device 25 as it travels therepast and the sliver can transfer device 25 can be configured to execute a sliver can transfer operation in response to engagement by a spinning station engagement bar. Additionally, in conjunction with transferring each sliver can 11–16 to its respective spinning station position, the sliver can transfer device 25 engages the end of the sliver within the sliver can and feeds the sliver end into the sliver intake hole 6 of the spinning box 7 of the respective spinning station. In this manner, each of the spinning stations S1–S6 is provided with a sliver can having a differing amount of sliver therein than the other sliver cans and each of the spinning stations is ready to begin the intake of sliver from the sliver can and the winding of a package on the initial tube 10 disposed thereat.

The other of the two processes contemplated by the present invention for providing each of the spinning stations with sliver cans having an initial amount of sliver therein is as follows. The sliver can transfer device 25 is controlled by the computer 28 to move to a position relative to a selected one of the spinning stations S1–S6 for transferring the sliver can thereat to the conveyor belt 31. The sliver can transfer device 25 then transfers the respective sliver can 11–16 to the conveyor belt 31 whereupon the computer 28 controls the operation of the conveyor belt motor 34 to effect movement of the conveyor belt 31 in the direction of the arrow 60 until the respective sliver can is positioned in sliver receiving position with respect to the sliver loader 35. For example, the figure illustrates the disposition of the sliver can 16 in sliver receiving position relative to the sliver loader 35 after the sliver can transfer device 25 has transferred the sliver can 16 from the spinning station S6 to the conveyor belt 31. As each can is successively positioned in sliver receiving position relative to the sliver loader 35 and subsequently receives its predetermined initial amount of sliver, the sliver can which was filled with sliver immediately prior thereto is conveyed by the conveyor belt 31, under the control of the computer 28, to a position adjacent its respective associated spinning station for transfer thereto by the sliver can transfer device 25. Accordingly, each sliver can is successively transferred by the sliver can transfer device 25 to the conveyor belt 31, conveyed to a sliver receiving position for receiving sliver from the sliver loader 35, conveyed back to a position adjacent its associated spinning station and transferred thereto by the sliver can transfer device 25. While two procedures have been discussed for providing each sliver can with a predetermined initial amount of sliver, the present invention contemplates that other sliver filling procedures can be equally preferable.

Upon completion of the supplying of each of the spinning stations S1–S6 with its associated sliver can having a predetermined quantity of sliver therein, the computer 28 ceases the batch start program and automatically commences the normal running operation of the spinning stations in a conventional manner.

Since each of the spin boxes 7 of the spinning stations S1–S6 are driven at the same rate by the spinning shaft 23, the spinning station having the sliver can with the smallest predetermined initial quantity of sliver typically is the first spinning station to exhaust its initial predetermined amount of sliver, although events such as yarn breaks or other disturbances which necessitate the cessation of spinning at a spinning station can create circumstances in which a spinning station other than the one provided with the smallest initial predetermined quantity of sliver is, in fact, the first spinning station to exhaust its initial supply of sliver. Assuming that the spinning station S1, whose associated sliver can 11 was initially provided with the smallest predetermined quantity of sliver (20% of capacity), is, in fact, the first spinning station to exhaust its initial supply of sliver, the computer 28 thereupon controls the sliver can transfer device 25 to travel to sliver can exchange position relative to the spinning station S1 to transfer the now empty sliver can 11 to the conveyor belt 31. The empty sliver can 11 is then conveyed by the conveyor belt 31, under the control of the computer 28, to a sliver receiving position relative to he sliver loader 35 and the sliver loader 35 is then actuated via the sliver controller 36 to fill the sliver can 11 to 100% of capacity. Thereafter, the conveyor belt 31 is controlled to convey the now full sliver can 11 to a transfer position adjacent its associated spinning station S1. Thereafter, the sliver can transfer device 25 transfers the full sliver can 11 to its sliver feeding position relative to the spinning station S1. Additionally, the sliver can transfer device 25 loads the sliver end of the sliver in the sliver can 11 into the sliver intake opening 6 of the spin box 7. Thereafter, the computer 28 actuates the spinning station S1 to resume its spinning operation.

The present invention also contemplates that additional sliver cans can be provided which are filled with a full quantity of sliver in correspondence with the sliver replenishment needs of the spinning stations S1–S6 so that a predetermined supply of full sliver cans is continuously available for transfer to the spinning stations. In this regard, the conveyor belt 31 can be configured to operate in conjunction with other conveyor belts to provide a sliver can circulating configuration.

In any event, the spinning stations S1–S6 are continuously provided with fresh full cans of sliver as the previously supplied quantity of sliver is exhausted. In this manner, the normal running of the batch continues with each of the spinning stations spinning the sliver supplied to it into yarn which is wound onto the tubes 10 to build full packages. Throughout the normal running of the batch, the sliver can transfer device 25 can either be parked in a predetermined rest position as shown in FIG. 1 or can be controlled to remain at the particular spinning station at which a sliver can transfer has just occurred.

Depending upon the number of packages to be completed, the batch can conceivably continue for hours, days or weeks. However, at some point prior to the completion of winding of the batch, the computer 28 can be operated to execute a batch ending program. The commencement of the batch ending program can be controlled either by instructions previously provided to the computer 28 or the computer can be manually actuated to start the batch ending program. The batch ending program by the computer 28 includes the step of initially determining an individual finishing quota of packages to be wound at each spinning station to effect completion of the batch. The individual finishing quota corresponds to the number of packages which can be substantially completely wound by the respective spinning station during a predetermined remaining batch running time.

The particular operations controlled by the computer 28 in the batch ending program are as follows. Since the computer 28 has previously been provided with information concerning the total number of packages to be completed in the batch and the characteristics of each of the packages, the computer 28 can determine the amount of sliver needed to wind each individual full package and can additionally determine the total amount of sliver needed to wind all of the packages of the batch. Thus, the computer 28 can calculate a maximum spinning time corresponding to the time needed to complete the winding of the packages of the batch, as measured from the beginning of the batch ending program time, by evaluating the number of packages which have already been completed at the beginning of the batch ending program in conjunction with information concerning the winding time and length of sliver needed to wind the remaining packages of the batch. The computer 28 then determines the individual finishing quota of packages for each respective spinning station S1–S6 in correspondence with a particular event such as, for example, the next package exchange occurring at the respective spinning station following the beginning of the batch ending program. Thus, for example, in correspondence with the package exchange the first spinning station to undergo a package exchange after the beginning of the batch ending program, the computer 28 calculates an individual finishing quota of packages which is to be wound by that spinning station within the remaining spinning time. Thereafter, when another spinning station undergoes a package exchange, the computer 28 determines an individual finishing quota of packages for that spinning station to be completed within the remaining spinning time. In this manner, an individual finishing quota of packages to be completed by each spinning station is eventually determined by the computer 28.

The amount of sliver which is drawn into the spinning stations in the intervals between the successive package exchange operations following the beginning of the batch ending program is monitored by the sliver counter 56 which provides this information via the connector 40 to the computer 28. The sliver counter 56 counts in response to rotation of the rotation sensor 55 which rotates in response to the rotation of the shaft 23. Thus, it is possible for the computer 28 to determine the amount of sliver which has been drawn in between the successive package exchange operations in correspondence with a calculation including the diameter of the draw-in roller and the rate of rotation of the shaft 23. The computer 28 can therefore determine the amount of sliver which has been drawn into the spinning stations since it last determined an individual finishing quota of packages for a particular spinning station. The computer 28 is thus continually provided with information from the sliver counter 56 to enable it to appropriately calculate the individual finishing quota of packages for the spinning stations.

To monitor the winding of the individual finishing quota of packages at each spinning station, the conventional sliver length detection devices 29.1–29.6 monitor the amount of sliver drawn in by the spinning stations. Since a predetermined length of sliver is required to build each package, the number of packages remaining to be completed in the individual finishing quota for each station can be calculated from the amount of sliver already wound during the batch ending program, which amount is detected by the sliver-length detection devices 29.1–29.6.

In executing the batch ending program, the computer 28 determines the number of packages to be wound from the sliver in a final can of sliver to be transported to each spinning station. Specifically, in response to monitoring of the sliver drawn into the respective spinning station by the respective sliver length detection device of the spinning station, the computer 28 determines at a particular time such as, for example, shortly before the exhaustion of the sliver in the can presently at the particular spinning station or after that sliver can has become exhausted, the appropriate quantity of sliver to be loaded into the final can for the particular spinning station. The appropriate quantity of sliver determined by the computer 28 to be loaded into the final can for the particular spinning station is the quantity of sliver substantially equal to the quantity of sliver required to complete the winding of the individual finishing quota of packages at the particular spinning station. Accordingly, the final sliver can at the particular spinning station will be substantially empty upon completion of the winding of the last full package of the individual finishing quota of packages of the particular spinning station.

When a spinning station requires a fresh sliver can and the computer 28 determines, in response to the monitoring of the spinning station by its sliver length detection device, that the next sliver can to be provided to the spinning station will be its final can, the computer controls the sliver filling device 26 to load the final sliver can for the spinning station with the appropriate finishing quantity of sliver. The final can is then conveyed to the spinning station, placed in sliver feeding position by the sliver can transfer device 25 and its sliver is fed into the sliver intake hole 6 of the spin box 7 of the spinning station for completion of the winding of the individual finishing quota of packages of the spinning station.

Thus, in accordance with the present invention, a batch of packages can be wound by the spinning stations of an automatic spinning machine such that the final sliver can at each respective spinning station is substantially emptied when that spinning station finishes the winding of its quota of packages. As can be understood, the various spinning stations typically finish the winding of their respective individual finishing quota of packages in a staggered manner since the spinning stations are initially provided with sliver cans having differing amounts of sliver, thereafter are provided with successive full cans of sliver and, finally, are provided with a final can of sliver having a predetermined amount of sliver. The staggered finishing sequence of the spinning stations enables another batch of a predetermined number of package to be started and, in this regard, a second type of start program can be executed by the computer 28 which takes advantages of the staggered finish of the spinning stations to optimally maximize the operating time of the sliver can transfer device 25 and the sliver filling device 26. Specifically, the second start program which is inputted into the second computer component 58 of the computer 28, is commenced while the previous batch is still being completed by the automatic spinning machine 1 and, preferably, when each of the spinning stations have already received their final cans of sliver for finishing their individual finishing quota of packages for the previous batch. In this manner the initial cans of the second batch can be fully filled when delivered to the spinning stations.

In accordance with the second start program, the computer 28 controls the sliver filling device 26 to fill each sliver can 11–16 with a uniform quantity of sliver such as, for example, a quantity of sliver equal to 100% of the capacity of the sliver can. To fill the cans with the selected uniform quantity of sliver, the sliver can transfer device 25 is controlled by the computer 28 to transfer the substantially or completely empty sliver can of the first spinning station to finish its individual finishing quota of packages of the previous batch and transfers the can to the conveyor belt 31 for conveying to the sliver filling device 26.

The present invention also contemplates that each individual spinning station can be provided with a sliver counter in lieu of the common sliver counter 56.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention.

The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A method for controlling the operation of a spinning machine of the type having a plurality of stations for spinning sliver into yarn and winding yarn into packages, the sliver being drawn from cans at the stations, a sliver can filling device and a sliver can transport device for transporting empty cans to the sliver can filling device and cans with sliver therein from the sliver can filling device to the stations, the sliver can transport device and the sliver can filling device being cooperatively operated to provide sliver cans containing sliver to the stations individually during the contemporaneous operation of the stations in winding a batch of a predetermined number of packages, comprising:

supplying each spinning station with a first can of sliver;

continuously replenishing the supply of sliver at each of the stations independently by removing cans from each station as they become empty and transporting full cans to the station;

prior to completion of winding of the batch, determining an individual finishing quota of packages to be wound at each station to complete the batch, said individual finishing quota corresponding to the number of packages which can be substantially completely wound by the respective spinning station within a predetermined remaining batch running time for each station;

monitoring the winding at each spinning station during the winding of the individual finishing quota of packages to determine, for each station, the number of packages to be wound from the sliver in a final can to be transported to each station; and in response to said monitoring, loading a quantity of sliver into each final can substantially equal to the quantity of sliver required to complete the winding of the individual finishing quota of packages at the respective spinning station, whereby the final sliver can of each spinning station is substantially empty upon completion of winding of the last full package of the individual finishing quota for the spinning station.

2. Method according to claim 1 and characterized further by setting one of a maximum sliver length to be spun to complete the batch and a spinning time to be run to complete the batch, and in that said determining is performed in correspondence with the completion of the next package at the respective spinning station following said setting.

3. A method according to claim 1 and characterized further in that said supplying includes supplying cans at the start of winding of the batch with unequal lengths of sliver in the cans at the different stations.

4. A method according to claim 1 and characterized further in that said monitoring the winding of each station includes monitoring the amount of sliver drawn into the spinning station.

5. A method according to claim 1 and characterized further by providing a can of sliver to each spinning station for the winding of packages of another batch following the completion thereat of said last full package of the individual finishing quota of the respective spinning station independent of completion of winding of the first batch at the other stations.

6. A method according to claim 5 and characterized further in that in said providing a can of sliver to each spinning station for the winding of packages of another batch said can is fully filled with sliver.

7. A method according to claim 5 and characterized further in that said providing a can of sliver to each spinning station for the winding of packages of another batch occurs following the winding of the last full package of the individual finishing quota of the last spinning station to complete its individual finishing quota of packages.

8. An apparatus for controlling the operation of a spinning machine of the type having a plurality of stations for spinning sliver into yarn and winding yarn into packages, the sliver being drawn from cans at the stations, comprising:

a sliver can filling device for individually filling the sliver cans with a selected quantity of sliver;

a sliver can transport device for transporting empty cans to the sliver can filling device and cans with sliver therein from said sliver can filling device to the stations, said sliver can transport device and said sliver can filling device being cooperatively operated to provide sliver cans containing sliver to the stations individually during the contemporaneous operation of the stations in winding a batch of a predetermined number of packages;

means for determining an individual finishing quota of packages to be wound at each station to complete said batch, said individual finishing quota corresponding to the number of packages which can be substantially completely wound by the respective spinning station within a predetermined remaining batch running time for the station; and means for monitoring the winding at each spinning station during the winding of the individual finishing quota of packages to determine, for each station, the number of packages to be wound from the sliver in a final can to be transported to each station, said monitoring means and said sliver can filling device being operably connected to one another and said sliver can filling device being operable to load a quantity of sliver into each final can in response to said monitoring of the winding at each station, said quantity of sliver in each final can being substantially equal to the quantity of sliver required to complete the winding of the individual finishing quota of packages at the respective spinning station, whereby the final sliver can of each spinning station is substantially empty upon completion of the winding of the last full package of the individual finishing quota of the spinning station.

* * * * *